US011834212B2

(12) United States Patent
Logue et al.

(10) Patent No.: US 11,834,212 B2
(45) Date of Patent: Dec. 5, 2023

(54) SYSTEMS AND METHODS FOR FILLING CONTAINERS

(71) Applicant: Woodstock Sterile Solutions, Inc., Woodstock, IL (US)

(72) Inventors: Matthew Logue, Woodstock, IL (US); Kevin C. Colangelo, Gurnee, IL (US)

(73) Assignee: Woodstock Sterile Solutions, Inc., Woodstock, IL (US)

( * ) Notice: Subject to any disclaimer, the term of this patent is extended or adjusted under 35 U.S.C. 154(b) by 0 days.

(21) Appl. No.: 16/640,967

(22) PCT Filed: Aug. 22, 2018

(86) PCT No.: PCT/US2018/047448
§ 371 (c)(1),
(2) Date: Feb. 21, 2020

(87) PCT Pub. No.: WO2019/040575
PCT Pub. Date: Feb. 28, 2019

(65) Prior Publication Data

US 2020/0172271 A1 Jun. 4, 2020

Related U.S. Application Data

(60) Provisional application No. 62/548,761, filed on Aug. 22, 2017.

(51) Int. Cl.
*B65B 3/26* (2006.01)
*B65B 3/00* (2006.01)
(Continued)

(52) U.S. Cl.
CPC ..... *B65B 3/26* (2013.01); *B65B 3/003* (2013.01); *B65B 3/022* (2013.01); *B65B 3/14* (2013.01); *B65B 57/145* (2013.01)

(58) Field of Classification Search
CPC ..... B65B 3/26; B65B 3/003; B65B 3/022; B65B 3/14; B65B 57/145
(Continued)

(56) References Cited

U.S. PATENT DOCUMENTS 1,538,427 A * 5/1925 Earl ..... G05D 9/02 137/593
3,597,793 A 8/1971 Weiler et al.
(Continued)

FOREIGN PATENT DOCUMENTS

DE 19951555 A1 5/2001
EP 0430897 A1 6/1991
(Continued)

OTHER PUBLICATIONS

LibreTexts: 14.3: Fluids, Density, and Pressure (Part 2). Website at: https://phys.libretexts.org/Bookshelves/University_Physics/Book%3A_University_Physics_(OpenStax)/Book%3A7University_Physics_I_-_Mechanics_Sound_Oscillations_and_Waves_(OpenStax)/14%3A_Fluid_Mechanics/14.03%3A_Fluids_Density_a (Year: 2020)*
(Continued)

*Primary Examiner* — David Colon-Morales
*Assistant Examiner* — Christopher M Afful
(74) *Attorney, Agent, or Firm* — Morrison & Foerster LLP

(57) ABSTRACT

A method of filling containers with liquid product includes receiving a signal from at least one sensor corresponding to an amount of liquid product in a holding tank, the holding tank having an outlet for feeding the liquid product to a container filling apparatus; transferring liquid product from the outlet of the holding tank to an inlet of the container filling apparatus; and filling at least one container with the liquid product through at least one nozzle of the container filling apparatus for a predetermined fill time, wherein an
(Continued)

amount of the liquid product dispensed during the predetermined fill time is based on a pressure at the outlet of the holding tank, wherein a head pressure in the holding tank is increased based on the signal from the sensor to control the pressure at the outlet of the holding tank as the liquid product is fed from the holding tank.

23 Claims, 6 Drawing Sheets

(51) Int. Cl.
*B65B 3/02* (2006.01)
*B65B 3/14* (2006.01)
*B65B 57/14* (2006.01)

(58) Field of Classification Search
USPC ..... 53/453
See application file for complete search history.

(56) References Cited

U.S. PATENT DOCUMENTS 4,450,981 A * 5/1984 Haig ..... B65B 3/14 137/209
5,319,979 A 6/1994 Abrahamson
5,632,315 A 5/1997 Rose
5,819,816 A 10/1998 Mayer
6,065,270 A 5/2000 Reinhard et al.
6,134,866 A 10/2000 Schoenewolff et al.
6,561,381 B1 * 5/2003 Osterheld ..... H01L 21/67253 222/61
6,595,250 B1 * 7/2003 Paulus ..... B65B 65/003 141/231
9,501,067 B2 * 11/2016 Vega ..... B05C 11/1013
2007/0219501 A1 9/2007 Kriesel et al.
2012/0074001 A1 * 3/2012 Genosar ..... A61J 1/2093 206/219
2012/0228325 A1 * 9/2012 Randall, Jr. ..... G01F 11/284 222/1
2013/0255827 A1 * 10/2013 Colangelo ..... B67C 3/2642 141/94
2014/0348700 A1 * 11/2014 Foreman ..... A61L 2/07 422/3
2015/0367969 A1 12/2015 Wong

FOREIGN PATENT DOCUMENTS

EP 1616549 10/2012
WO WO-2010144439 A2 * 12/2010 ..... B01F 15/0203

OTHER PUBLICATIONS

International Search Report and Written Opinion dated Oct. 18, 2018, directed to International Application No. PCT/US2018/047448; 13 pages.
Extended European Search Report dated Jul. 7, 2021, directed to EP Application No. 18848021.4; 11 pages.

* cited by examiner

SYSTEMS AND METHODS FOR FILLING CONTAINERS

CROSS-REFERENCE TO RELATED APPLICATION

This application is a U.S. national stage application under 35 U.S.C. 371 of International Patent Application No. PCT/US2018/047448, filed Aug. 22, 2018, which claims the priority of U.S. Provisional Application No. 62/548,761, filed Aug. 22, 2017, the entire contents of each of which are incorporated herein by reference.

FIELD OF THE INVENTION

This invention relates generally to product filling systems and, more specifically, to blow-fill-seal systems.

BACKGROUND OF THE INVENTION

Product filling systems are widely used in a variety of industries. Some product filling systems employ blow-fill-seal (BFS) technology. BFS technology is a manufacturing process that comprises forming, filling, and sealing containers in a continuous process. BFS technology may be used to aseptically manufacture sterile pharmaceutical products. In a BFS manufacturing process, a plastic resin is first extruded into a tubular shape called a parison. When the parison reaches a predetermined length, a mold closes around the parison and the parison is cut, creating an open vial. A nozzle is inserted into the vial and blows air to expand the nozzle against the walls of the mold to form a container. Product is then dispensed into the container through a fill nozzle. The fill nozzle then retracts and a separate top mold is closed to seal the container.

FIG. 1 illustrates a conventional BFS machine 100 similar to that described in U.S. Pat. No. 6,134,866 to Schenewolff. BFS machine 100 includes an extruder 102 connected to an extruder barrel 104 for extruding a parison 106, and reciprocally mounted molds 108. The molds 108 can include multiple mold cavities 110 for simultaneously molding multiple product containers by the blow-fill-sealing process. The molds 108 may be mounted for reciprocal movement between the solid line position beneath the extruder barrel 104 and the dashed line position beneath the product filling head 112. The product filling head 112 includes one or more filling nozzles 114 for filling the molded product containers with product prior to the final sealing step. On completion of the blowing, filling, and sealing process, the molded and filled product containers 116 may be transported by conveyor 118 to a suitable packing area for packing and shipping of the pre-filled plastic syringes. Product, which may be held in a holding tank, is fed to the BFS machine through product inlet 120.

Conventionally, product is transferred from a product holding tank to a BFS machine for filling individual containers by a pressure differential between the holding tank and the filling nozzle of the BFS machine. The amount of product dispensed into a container in the BFS is typically determined by the pressure of the product at the BFS machine and the amount of filling time. An operator may monitor the filling process and adjust the filling time to account for variations in pressure at the BFS machine that may be due to loss of product volume in the product holding tank.

SUMMARY OF THE INVENTION

Described within are systems and methods for maintaining the outlet pressure of a holding tank to allow for consistent filling of product containers over a complete batch cycle. The system includes a holding tank and a controller for increasing pressure in the holding tank. As product is dispensed from the holding tank during a batch-filling cycle, the controller receives a signal from a sensor corresponding to the amount of product remaining in the holding tank. As the amount of product in the holding tank decreases, the controller increases the pressure in the holding tank, compensating for the product elevation pressure loss, to maintain a constant product pressure at the output of the holding tank. Therefore, consistent amounts of product may be dispensed into individual containers throughout the batch cycle without the need to monitor or adjust the filling time.

According to some embodiments, a method of filling containers with liquid product, includes: receiving, by a controller, a signal from at least one sensor corresponding to an amount of liquid product in a holding tank, the holding tank having an outlet for feeding the liquid product to a container filling apparatus; transferring liquid product from the outlet of the holding tank to an inlet of the container filling apparatus; and filling at least one container with the liquid product through at least one nozzle of the container filling apparatus for a predetermined fill time, wherein an amount of the liquid product dispensed during the predetermined fill time is based on a pressure at the outlet of the holding tank, wherein a head pressure in the holding tank is increased based on at least the signal from the at least one sensor to control the pressure at the outlet of the holding tank as the liquid product is fed from the holding tank.

In any of these embodiments, the controller may include a pressure regulator for increasing the head pressure of the holding tank. In any of these embodiments, the head pressure may be increased based on a density of the liquid product. In any of these embodiments, the amount of the liquid product dispensed during the predetermined fill time may be a linear function of the pressure at the outlet of the holding tank.

In any of these embodiments, the container filling apparatus may be a blow-fill-seal apparatus. In any of these embodiments, the container filling apparatus may be configured to mold the at least one container. In any of these embodiments, the container filling apparatus may include a first nozzle for ejecting a gas for forming the at least one container and a second nozzle for dispensing the liquid product.

In any of these embodiments, the at least one sensor may include a load cell, an optical sensor, or an acoustic sensor. In any of these embodiments, the pressure at the outlet of the container filling apparatus may be maintained within 10% of a pressure set point.

In any of these embodiments, the holding tank may be configured to continuously feed a batch of the liquid product to the container filling apparatus for at least 1 hour. In any of these embodiments, the holding tank may have a volume of at least 10 liters.

In any of these embodiments, the container filling apparatus may be configured to fill a container with an amount of liquid product of less than 100 mL. In any of these embodiments, the liquid product may be a pharmaceutical product. In any of these embodiments, the at least one container may be sealed within the container filling apparatus after being filled.

According to some embodiments, a container filling system may include a holding tank configured to contain a liquid product; a container filling apparatus comprising an inlet for receiving liquid product from the holding tank and at least one nozzle for filling containers, the container filling apparatus being configured to fill a container with liquid product for a predetermined fill time, wherein an amount of the liquid product filled during the predetermined fill time is based on a pressure at an outlet of the holding tank; at least one sensor configured to generate a signal corresponding to an amount of liquid product in the holding tank; and a controller configured to receive the signal from the at least one sensor and to increase a head pressure of the holding tank based on at least the signal from the at least one sensor to control the pressure at the outlet of the holding tank as the liquid product is fed from the holding tank to the container filling apparatus.

In any of these embodiments, the controller may include a pressure regulator for increasing the head pressure of the holding tank. In any of these embodiments, the container filling apparatus may be a blow-fill-seal apparatus. In any of these embodiments, the container filling apparatus may be configured to mold the container.

In any of these embodiments, the container filling apparatus may include a first nozzle for ejecting a gas for forming the container and a second nozzle for dispensing the liquid product. In any of these embodiments, the at least one sensor may include a load cell, an optical sensor, or an acoustic sensor.

In any of these embodiments, the holding tank may have a volume of at least 10 liters. In any of these embodiments, the container filling apparatus may be configured to fill the container with an amount of liquid product of less than 100 mL.

In any of these embodiments, the liquid product may be a pharmaceutical product. In any of these embodiments, the container filling apparatus may be configured to seal the container after filling the container.

BRIEF DESCRIPTION OF THE DRAWINGS

The invention will now be described, by way of example only, with reference to the accompanying drawings, in which.

DETAILED DESCRIPTION OF EXEMPLARY EMBODIMENTS

Described within are systems and methods for maintaining consistent filling in material filling systems. According to some embodiments, the system includes a dispensing system, a holding tank, a control system for controlling the pressure of the material, and a sensor for measuring the amount of material in a holding tank. As material is dispensed from the holding tank to the dispensing system during a batch-filling cycle, the controller receives a signal from the sensor corresponding to the amount of material remaining in the holding tank. As the amount of material in the holding tank decreases, the controller increases the head pressure of the holding tank to maintain a constant material pressure at the output of the holding tank (i.e., to compensate for the product elevation pressure loss). Therefore, consistent amounts of material may be dispensed into individual containers throughout the batch cycle without the need to monitor or adjust the filling time.

In some embodiments, the system may include a blow-fill-seal apparatus. In a conventional BFS system, the amount of material dispensed into each container depends on a filling time and a filling pressure. The material pressure at the outlet of the holding tank may correspond to the pressure at the inlet of the BFS and/or the filling pressure at the dispenser of a BFS. Therefore, by controlling the material pressure at the outlet of the holding tank, the system controls the pressure at the inlet of the BFS and/or the filling pressure at the BFS dispenser. By controlling pressure at the BFS, filling times do not need to be adjusted over the course of a batch-filling cycle.

In the following description of the disclosure and embodiments, reference is made to the accompanying drawings in which are shown, by way of illustration, specific embodiments that can be practiced. It is to be understood that other embodiments and examples can be practiced, and changes can be made, without departing from the scope of the disclosure.

In addition, it is also to be understood that the singular forms "a," "an," and "the" used in the following description are intended to include the plural forms as well, unless the context clearly indicates otherwise. It is also to be understood that the term "and/or," as used herein, refers to and encompasses any and all possible combinations of one or more of the associated listed items. It is further to be understood that the terms "includes," "including," "comprises," and/or "comprising," when used herein, specify the presence of stated features, integers, steps, operations, elements, components, and/or units, but do not preclude the presence or addition of one of more other features, integers, steps, operations, elements, components, units, and/or groups thereof.

Figure 1:
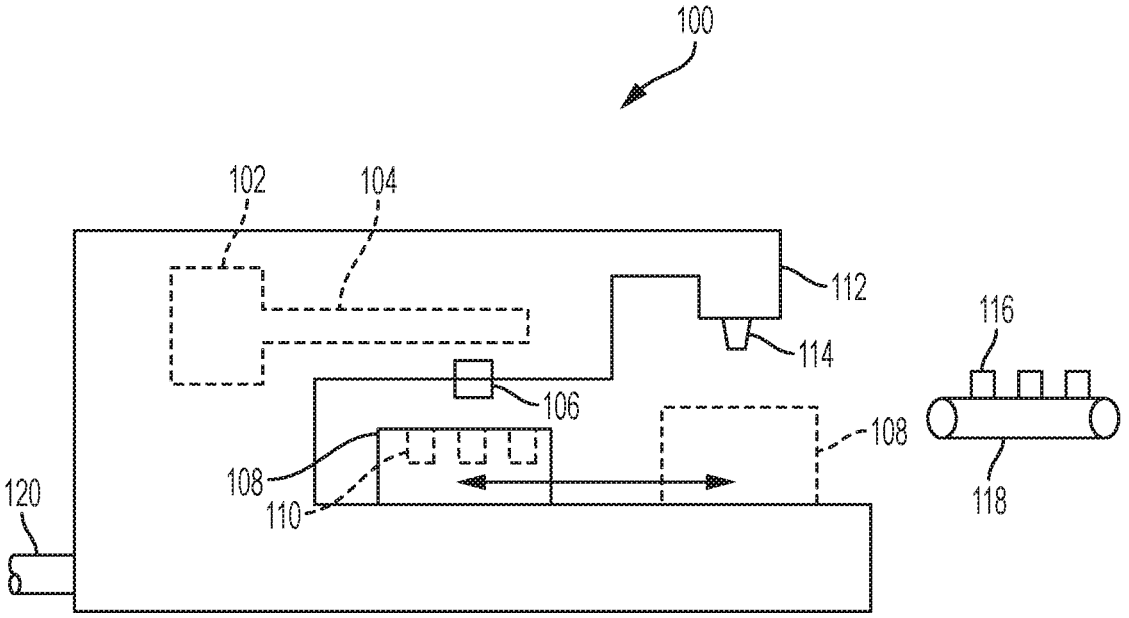
FIG. 1 PRIOR ART
FIG. 1 illustrates a conventional BFS apparatus.
Figure 2:
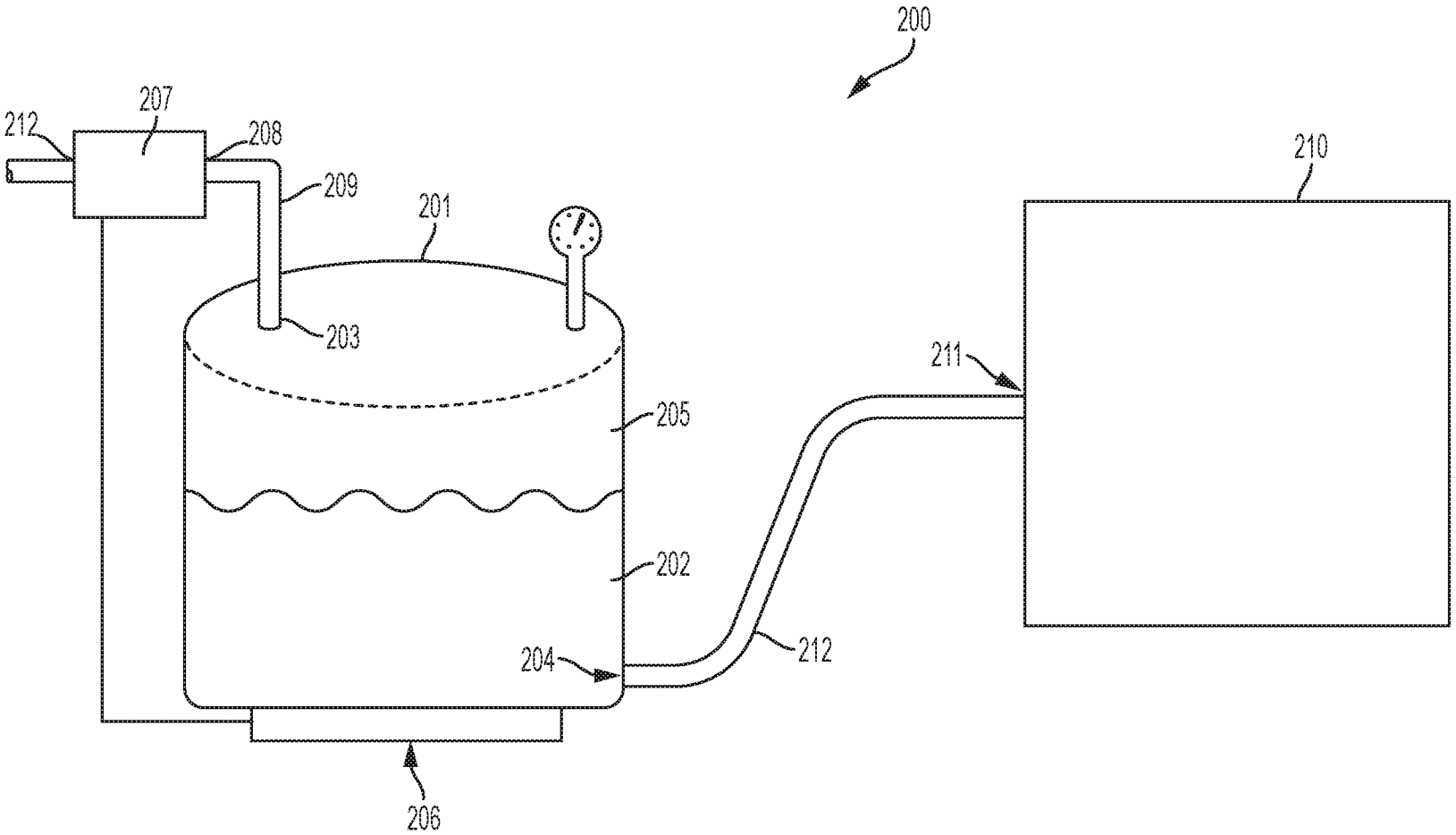
FIG. 2 illustrates a product filling system, according to some embodiments.

FIG. 2 illustrates a container filling system 200 according to some embodiments. System 200 may maintain consistent container filling throughout a batch filling cycle by maintaining a consistent product line pressure. System 200 includes a holding tank 201 and a container filling apparatus 210. In some embodiments, the container filling apparatus 210 may be a BFS apparatus, such as BFS 100 of FIG. 1.

Holding tank 201 holds product 202 that is fed to the container filling apparatus 210 for filling product containers. The product 202 held in holding tank 201 may be any type of product capable of flowing through the system via a pressure gradient and is typically a liquid product. In some embodiments, the product is a liquid pharmaceutical or other sterile liquid product for human use and/or consumption. Holding tank 201 may be any suitable holding tank, such as a stainless steel tank dimensioned according to production line specifications.

Product may be moved from holding tank 201 through flow line 212 to container filling apparatus 210 by a pressure delta between at least one product outlet 204 of holding tank 201 and the container filling apparatus 210. The pressure delta may be controlled via a pressurized head space 205 in the holding tank 201. Holding tank 201 has a pressurized gas inlet 203 through which pressurized gas can be used to pressurize the head space 205 of the holding tank. Flow line 212 may be a continuous length of piping or may be a substantially continuous length of piping interrupted only by one or more valves and/or pressure gauges.

Container filling apparatus 210 is configured to dispense product fed from the holding tank 201 into containers in a substantially continuous manufacturing process. In some embodiments, container filling apparatus 210 is a standard BFS machine such as BFS machine 100 shown in FIG. 1. As explained above, the BFS machine is adapted to form the container into which the product is filled. A mold in the BFS machine closes around a parison to form the container. After formation of the container, the BFS machine inserts a product filling nozzle into the container in order to fill the container with product.

During operation, the holding tank 201 contains a dispensable product 202 and the head space 205 is pressurized with a gas such as air, nitrogen, or other suitable gas. Product is held in a tank 201 until it is ready to be transferred to container filling apparatus 210. The product held in the holding tank 201 may be in a state ready for final packaging.

The product moves from holding tank 201 due to the pressure gradient between the holding tank 201 and the container filling apparatus 210. Once transferred from the holding tank 201 into the flow line 212, the product traverses the system to the container filling apparatus 210. According to some embodiments, the flow line 212 from the holding tank 201 to the container filling apparatus 210 does not include any energy adding device such as a tank such that the pressure of the product at the container filling apparatus 210 is a linear function of the pressure of the product at the outlet of the holding tank 201.

Containers are filled by the container filling apparatus 210 with product fed from the holding tank 201. In some embodiments, the containers are filled for a predetermined filling time.

In some embodiments, the container filling apparatus is BFS machine 100 and containers are formed in BFS machine 100 prior to being filled. During the formation of the container, the mold closes around the parison material that is to be used to form the container. BFS machine 100 fills the formed container with product. Prior to filling the container, product may remain for a residence time in flow line 212. Only when the filling step actually takes place, which may typically occur over period of about 0.5-1.5 seconds out of a 12-15 second overall blow-fill-seal cycle, is the product moving.

Generally, the pressure of the dispensable product 202 at the product outlet 204 of the holding tank 201 is based on the pressure of the head space 205, the geometry of the holding tank 201, the amount of product 202 in the holding tank, and the density of the product 202. As product is dispensed from the holding tank 201 during operation and the amount of product in the holding tank decreases, the product pressure at the product outlet 204 decreases if the head pressure remains constant. The head pressure can be increased to maintain a consistent pressure at the product outlet 204 as product is fed from the holding tank 201 during operation. Because the density of the product 202 and the geometry of the holding tank 201 generally do not change during operation, the head pressure may be adjusted to maintain a constant pressure at the product outlet 204 based on changes in the amount of product in the tank.

The head pressure in the holding tank 201 is controlled by pressure control system 207. The pressure control system 207 has a control outlet 208 that feeds pressurized gas into the pressure inlet 203. The control system 207 may include an inlet 212 for connection to a pressurized gas source or supply line. For example, the inlet 212 may be connected to a facility pressurized gas line or to a compressor. The control outlet 208 is connected to the pressure inlet 203 by a pressurized line 209.

System 200 includes a sensor 206 for measuring the amount of product 202 in the holding tank 201. The sensor 206 generates a signal corresponding to the amount of product 202 in the holding tank 201.

During operation, the pressure control system 207 receives a signal from the sensor 206 corresponding to the amount of product in the holding tank 201. As the amount of product in the holding tank decreases, the pressure control system 207 may adjust the head pressure of the holding tank 201 to maintain a constant pressure at the product outlet 204. By maintaining a constant pressure at the product outlet 204, the container filling apparatus 210 may fill containers with consistent product quantities without the need to adjust the fill time.

The signal received by the pressure control system 207 may represent various quantities corresponding to the amount of product in the holding tank 201. In some embodiments, the signal may be based on the weight of the holding tank 201 and the product 202, and the pressure control system 207 may determine the amount by which to adjust the head pressure based on the signal, the density of the product, and dimensions of the holding tank 201. Alternatively, the signal may represent the level of the product 202 in the holding tank 201, and the pressure control system 207 may determine the amount by which to adjust the head pressure based on the signal and density of the product.

The holding tank 201 may be of various types, products, and geometries. For example, the holding tank 201 may be an aseptic tank to prevent contamination by biological agents. The holding tank 201 may be a batch-mix tank or a blender tank for processing and/or preparing product prior to beginning the filling process, a fermentation tank, a horizontal processor, a round horizontal tank, a separator, a silo, a vacuum tank, or other type of tank. The holding tank 201 may be made of steel, stainless steel, copper, fiberglass, plastic, or any other suitable material. The holding tank 201 may be substantially cylindrical, rectangular, spherical, or any other suitable shape.

The holding tank 201 may be any suitable size. For example, the volume of the holding tank 201 may be less than 5 liters, less than 10 liters, less than 20 liters, less than 50 liters, less than 100 liters, less than 200 liters, less than 500 liters, less than 1,000 liters, less than 2,000 liters, or less than 5,000 liters. According to some embodiments, the volume of the holding tank 201 may be greater than 5 liters, greater than 10 liters, greater than 20 liters, greater than 50 liters, greater than 100 liters, greater than 200 liters, greater than 500 liters, greater than 1,000 liters, greater than 2,000 liters, or greater than 5,000 liters. According to some embodiments, the diameter of the holding tank 201 may be less than 2 feet, less than 3 feet, less than 4 feet, less than 5 feet, less than 6 feet, less than 10 feet, or less than 20 feet. According to other embodiments, the diameter of the holding tank 201 may be greater than 2 feet, greater than 3 feet, greater than 4 feet, greater than 5 feet, greater than 6 feet, greater than 10 feet or greater than 20 feet. According to some embodiments, the height of the holding tank 201 may be less than 2 feet, less than 3 feet, less than 4 feet, less than 5 feet, less than 6 feet, less than 10 feet, or less than 20 feet. According to other embodiments, the height of the holding tank 201 may be greater than 2 feet, greater than 3 feet, greater than 4 feet, greater than 5 feet, greater than 6 feet, greater than 10 feet or greater than 20 feet.

The head pressure of the holding tank 201 may be maintained at any suitable pressure, which may depend, for example, on the feed pressure requirements of the container filling apparatus 210 and/or on the configuration of the flow line 212. For example, the head pressure of the holding tank may be less than 1 p.s.i., less than 2 p.s.i., less than 3 p.s.i., less than 4 p.s.i., less than 5 p.s.i., less than 6 p.s.i., less than 7 p.s.i., less than 10 p.s.i., or less than 20 p.s.i. In some embodiments, the head pressure of the holding tank may be greater than 1 p.s.i., greater than 2 p.s.i., greater than 3 p.s.i., greater than 4 p.s.i., greater than 5 p.s.i., greater than 6 p.s.i., greater than 7 p.s.i., greater than 10 p.s.i., or greater than 20 p.s.i.

The outlet pressure of the holding tank 201 may be maintained at various pressures. For example, the holding tank outlet pressure may be less than 1 p.s.i., less than 2 p.s.i., less than 3 p.s.i., less than 4 p.s.i., less than 5 p.s.i., less than 6 p.s.i., less than 7 p.s.i., less than 10 p.s.i., or less than 20 p.s.i. In some embodiments, the holding tank outlet pressure may be greater than 1 p.s.i., greater than 2 p.s.i., greater than 3 p.s.i., greater than 4 p.s.i., greater than 5 p.s.i., greater than 6 p.s.i., greater than 7 p.s.i., greater than 10 p.s.i., or greater than 20 p.s.i.

In some embodiments, the pressure control system 207 may be configured to allow a user to specify a desired product pressure set point for the pressure control system 207. The pressure set point may correspond to a feed pressure required by the container filling apparatus 210. Alternatively, the pressure control system 207 may be configured to use a default pressure set point to set the pressure of the holding tank 201.

In some embodiments, the pressure control system 207 may be configured to allow a user to specify a percentage by which the product pressure may deviate from the set point pressure. Alternatively, the pressure control system 207 may be configured to use a default pressure tolerance to control the pressure of the holding tank 201. During operation, the pressure control system 207 may adjust the head pressure of the holding tank 201 if the control system determines, based on the signal from the sensor 206, that the product pressure has deviated from the pressure set point by an amount greater than the specified tolerance. For example, the pressure control system may maintain the product pressure at the tank outlet 204 within ±0.1%, within ±0.5%, within ±1%, within ±3%, within ±4%, or within ±5% of the pressure set point.

In other embodiments, the pressure tolerance may be expressed in absolute, rather than relative, terms. For example, the pressure tolerance may be ±0.1 p.s.i. from the pressure set point rather than ±0.1% of the pressure set point.

Because the density of the product 202 and the geometry of the holding tank 201 do not change during operation, the pressure control system 207 may be preconfigured with a density and/or geometry to be used to determine the amount by which to adjust the head pressure of the holding tank 201 during operation. For example, the pressure control system 207 may allow a user to specify the density of the product and/or the geometry of the holding tank prior to operation. Accordingly, during operation the pressure control system may adjust the head pressure of the holding tank 201 based on the product density and/or holding tank geometry specified by the user. Alternatively, the pressure control system 207 may adjust the head pressure of the holding tank 201 based on a default density and/or geometry of the holding tank if a user does not specify a product density and/or holding tank geometry.

The sensor 206 may be of various types. The sensor 206 may comprise a load cell, an optical sensor, an acoustic sensor, and/or any other type of sensor capable of measuring the amount of product in the holding tank 201. For example, the sensor 206 may comprise one or more load cells positioned at the bottom of the holding tank 201 to measure the weight of the tank. In other embodiments, the sensor 206 may comprise one or more optical sensors positioned above the top of the surface of the product in the holding tank 201 to measure the distance to the surface of the product.

In some embodiments, the sensor 206 may be a single sensor. In other embodiments, the sensor 206 may include multiple sensors. For example, the sensor 206 may include two or more load cells. The pressure control system 207 may receive signals from multiple sensors and combine the signals to determine the amount of product in the holding tank 201. For example, the pressure control system 207 may add signals from two load cells to determine the total amount of product in the holding tank 201. The sensor 206 may include multiple sensors of different types. For example, the sensor 206 may include a load cell and an optical sensor. In some embodiments, the sensor 206 may transmit the signal wirelessly. For example, the sensor may transmit the signal via Wi-Fi, Bluetooth, WiMAx, cellular, Zigbee, or other wireless technology.

In some embodiments, the sensor 206 may include a transducer and a controller. The transducer may generate a signal corresponding to the amount of product in the holding tank 201 and the controller may transmit the signal or a transformation of the signal to the pressure control system 207. For example, the controller may convert an analog signal from the sensor to a digital signal transmitted to the control system 207.

In some embodiments, the sensor 206 may continuously generate and/or transmit a signal corresponding to the amount of product in the holding tank 201. For example, sensor 206 may generate an analog signal continuously. Alternatively, the sensor 206 may generate and/or transmit a signal corresponding to the amount of product in the holding tank 201 at discrete intervals. The discrete intervals may be based on a sampling rate or a clock cycle or may be based on a duty cycle. For example, the sensor 206 may generate and/or transmit a signal every 10 seconds.

The container filling apparatus 210 may be configured to dispense various products. For example, the container filling apparatus 210 may be a BFS machine configured to dispense pharmaceutical products such as antibiotics, ophthalmological drops, dialysis solutions, or other products. In some embodiments, the container filling apparatus 210 may be configured to dispense beverages, such as juice, soda, milk, beer, water, or other products. In other embodiments, the container filling apparatus 210 may be configured to dispense non-liquid products, such as creams, powders, or other products.

The container filling apparatus 210 may be configured to dispense product in various quantities. The quantity of product dispensed by the container filling apparatus 210 may depend on the volume of containers to be filled. For example, the container filling apparatus 210 may be configured to dispense product in quantities of less than 0.5 mL, less than 1 mL, less than 2 mL, less than 10 mL, less than 100 mL, less than 0.5 L, or less than 1 L. In some embodiments, the container filling apparatus 210 may be configured to dispense product in quantities of greater than 0.5 mL, greater than 1 mL, greater than 2 mL, greater than 10 mL, greater than 100 mL, greater than 0.5 L, or greater than 1 L.

The container filling apparatus 210 may be configured to operate with various inlet pressures at dispenser inlet 211. For example, the dispenser inlet pressure may be less than 1 p.s.i., less than 2 p.s.i., less than 3 p.s.i., less than 4 p.s.i., less than 5 p.s.i., less than 6 p.s.i., less than 7 p.s.i., less than 10 p.s.i., or less than 20 p.s.i. In some embodiments, the dispenser inlet pressure may be greater than 1 p.s.i., greater than 2 p.s.i., greater than 3 p.s.i., greater than 4 p.s.i., greater than 5 p.s.i., greater than 6 p.s.i., greater than 7 p.s.i., greater than 10 p.s.i., or greater than 20 p.s.i.

Figure 3:
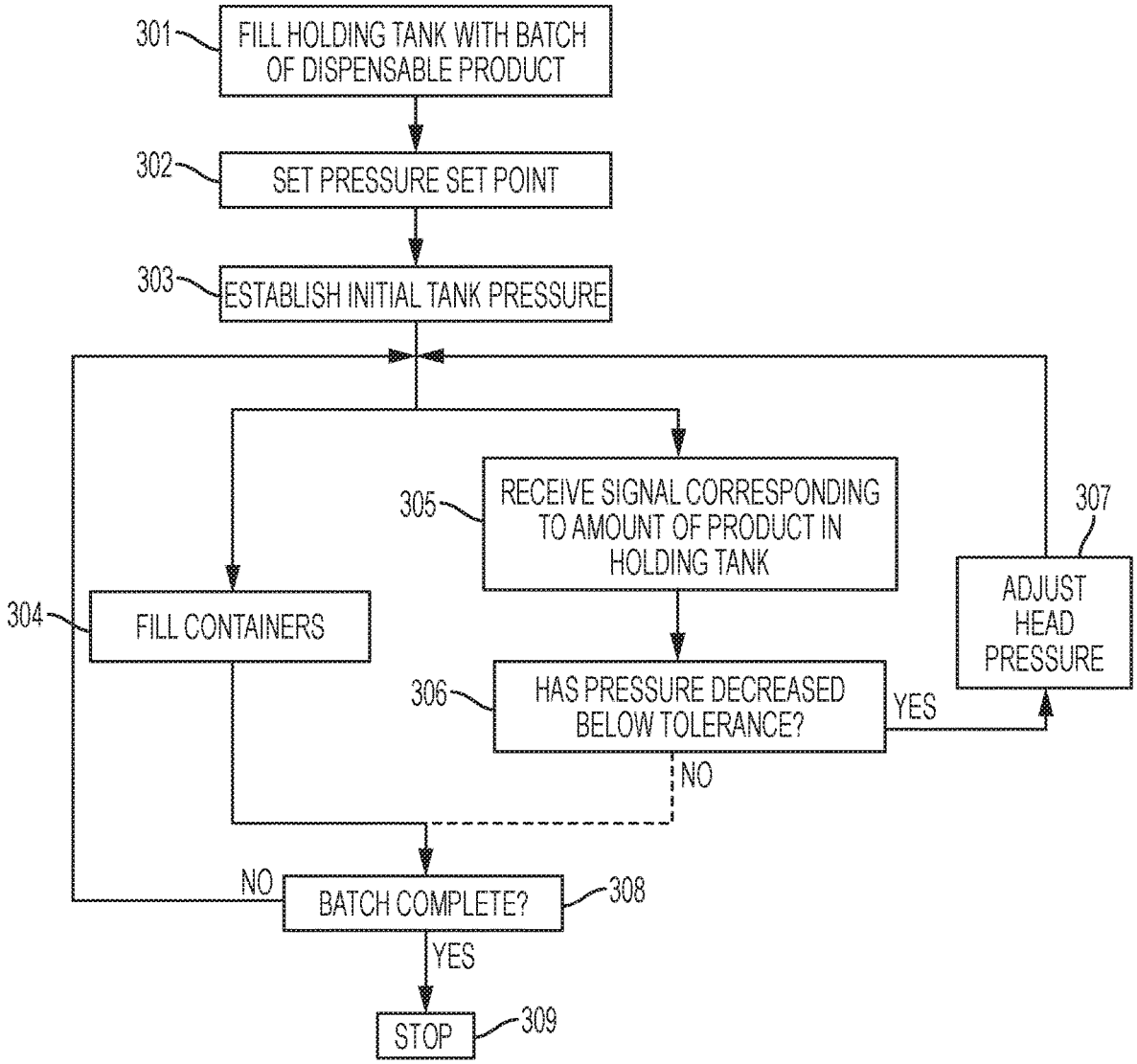
FIG. 3 is an exemplary flow diagram of a complete batch cycle, according to some embodiments.

FIG. 3 is an exemplary flow diagram of a complete batch-filling cycle, according to some embodiments. At step 301, the filling cycle begins by filling a holding tank with a batch of dispensable product. At step 301, the dispensable product may be synthesized in the holding tank by combining multiple component products. For example, the holding tank may be filled with multiple component products that are mixed together in the holding tank to create the product to be dispensed.

At step 302, a user may set various parameters to be used by the pressure control system. For example, a user may set a pressure set point corresponding to the desired product filling pressure of the system. Alternatively, the pressure control system may use a default pressure set point if no value is set by the user. The user may optionally set a pressure tolerance for the pressure control system. Alternatively, the pressure control system may use a default pressure tolerance if no value is set by the user. The user may optionally set a product density and/or holding tank geometry to be used to by the pressure control system to determine the amounts by which to adjust the head pressure. Alternatively, the pressure control system may use a default product density and/or holding tank geometry if not value is set by the user.

At step 303 the head pressure of the holding tank is charged to an initial pressure. The initial pressure may correspond to the pressure set point chosen by the user. Alternatively, the initial pressure may correspond to a default pressure set point of the pressure control system.

After step 303, the filling cycle proceeds in two parallel processes. In one process, the dispenser begins filling containers with the dispensable product at step 304. If the complete batch of product has been dispensed at step 308 after one or more containers have been filled, the filling cycle ends and no more containers are filled. Alternatively, if the complete batch of product has not been filled at step 308, step 304 is repeated and the dispenser continues filling containers.

A complete batch may have been dispensed under various conditions. For example, a complete batch may have been dispensed when only a residual amount of the dispensable product remains in the holding tank. In some embodiments, an amount of the dispensable product may remain in the holding tank after a complete batch has been filled to prevent air from entering the product outlet of the holding tank. Alternatively, a complete batch may have been dispensed with a predetermined number of containers have been filled.

In a second, parallel process, at step 305 the pressure control system receives a signal from a sensor corresponding to the amount of product in the holding tank. At step 306 the pressure control system evaluates whether the product pressure has deviated from the pressure set point by an amount greater than the pressure tolerance. If the product pressure has deviated from the pressure set point by an amount greater than the pressure tolerance, the pressure control system automatically adjusts the head pressure of the holding tank at step 307 to maintain the product pressure within the pressure tolerance around the pressure set point. After the head pressure of the holding tank is adjusted, the process returns to step 305 to continue monitoring the pressure of the holding tank.

If the product pressure has not deviated from the pressure set point by an amount greater than the pressure tolerance and the complete batch of product has been filled, the filling cycle ends and no more containers are filled. If the complete batch of product has not been filled, the process returns to step 305 to continue monitoring the pressure of the holding tank.

The rate at which the process of monitoring and adjusting the pressure of the system may vary. In some dispensers, such as a BFS, individual containers are successively formed, filled, and sealed by the BFS at periodic intervals. In some embodiments, the pressure monitoring and adjustment at steps 305, 306, and 307 may execute independently of the filling process of step 304. For example, the pressure control system may monitor and adjust the pressure of the holding tank at various times during the dispenser filling cycle. In some embodiments, the pressure control system may monitor and adjust the pressure of the holding tank based on the sampling rate of a controller, which may not correspond to the duration of a single filling cycle.

Alternatively, the pressure monitoring and adjustment of steps 305, 306, and 307 may execute in concert with the iterative filling process of step 304. For example, after each container is formed, filled, and sealed, the pressure control system may execute steps 305, 306, and 307 before the dispenser begins forming and filling the next container. In some embodiments, the pressure control system may monitor and adjust the holding tank pressure after groups of containers have been filled. For example, the pressure control system may monitor and adjust the holding tank pressure after every 10 containers have been filled.

A batch cycle may execute for a period of time depending on the amount of product initially filled into the holding tank, the amount of product dispensed by the dispenser into each container, and the time interval between each container. For example, the holding tank may continuously feed a batch of product to the dispenser for up to 1 hour, up to 5 hours, up to 1 day, up to 5 days, or up to 10 days.

Figure 4:
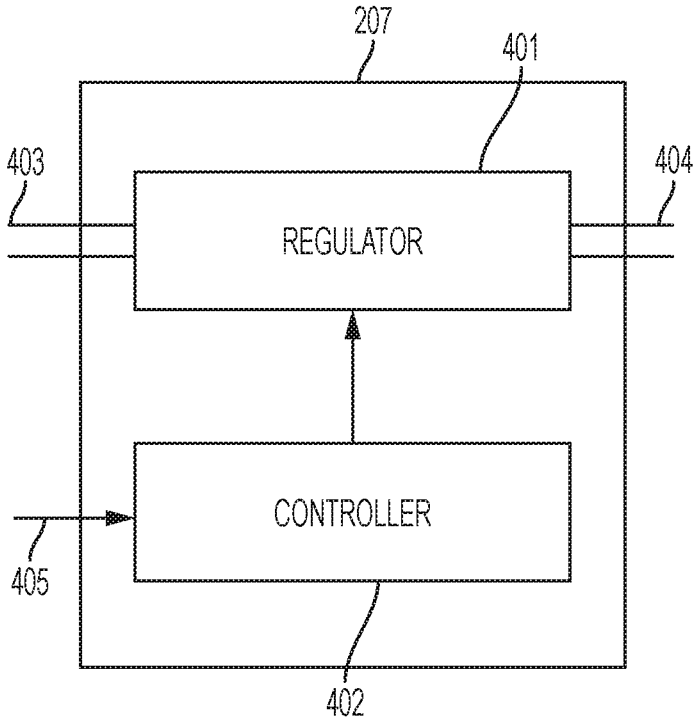
FIG. 4 is an exemplary diagram of a pressure control system in accordance with one embodiment.

FIG. 4 illustrates an exemplary embodiment of a pressure control system 207. The pressure control system of FIG. 4 includes a pressure regulator 401 and a controller 402.

The pressure regulator 401 has a pressure inlet 403 and a pressure outlet 404. The pressure regulator 401 regulates the pressure at the pressure outlet 404. The pressure outlet 404 may be connected to an inlet of a holding tank. The pressure inlet 403 may have a higher pressure than the pressure outlet 404, and the regulator 401 may reduce the pressure to control the pressure at the pressure outlet 404. The pressure outlet 404 may feed pressurized gas into a holding tank to set the head pressure of the holding tank.

The controller 402 controls the pressure regulator 401 by setting the pressure set point of the regulator. The controller 402 receives a signal 405 corresponding to the amount of product in a holding tank and adjusts the pressure set point of the regulator 401 based on the signal 405.

The pressure control system 207 may be retrofitted into existing product filling systems. For example, the pressure control system 207 may replace an existing pressure control element that does not include a controller 402 without replacing or modifying other elements of the filling system. Alternatively, the pressure control system 207 may be inserted into a pressurized gas line that feeds pressurized gas into a holding tank without replacing or modifying other elements of the filling system.

The controller 402 may be of various types. For example, the controller 402 may be a programmable logic controller, a microcontroller, or other computing device capable of controlling the pressure set point of a pressure regulator. In some embodiments, the controller 402 may control the pressure set point by a digital or analog electrical signal. For example, the controller may control the regulator by a current, a voltage, or a serial digital signal.

The regulator 401 may be of various types. For example, the regulator 401 may be an electronic regulator or other type of regulator capable of regulating the pressure at the pressure outlet 404.

Figure 5:
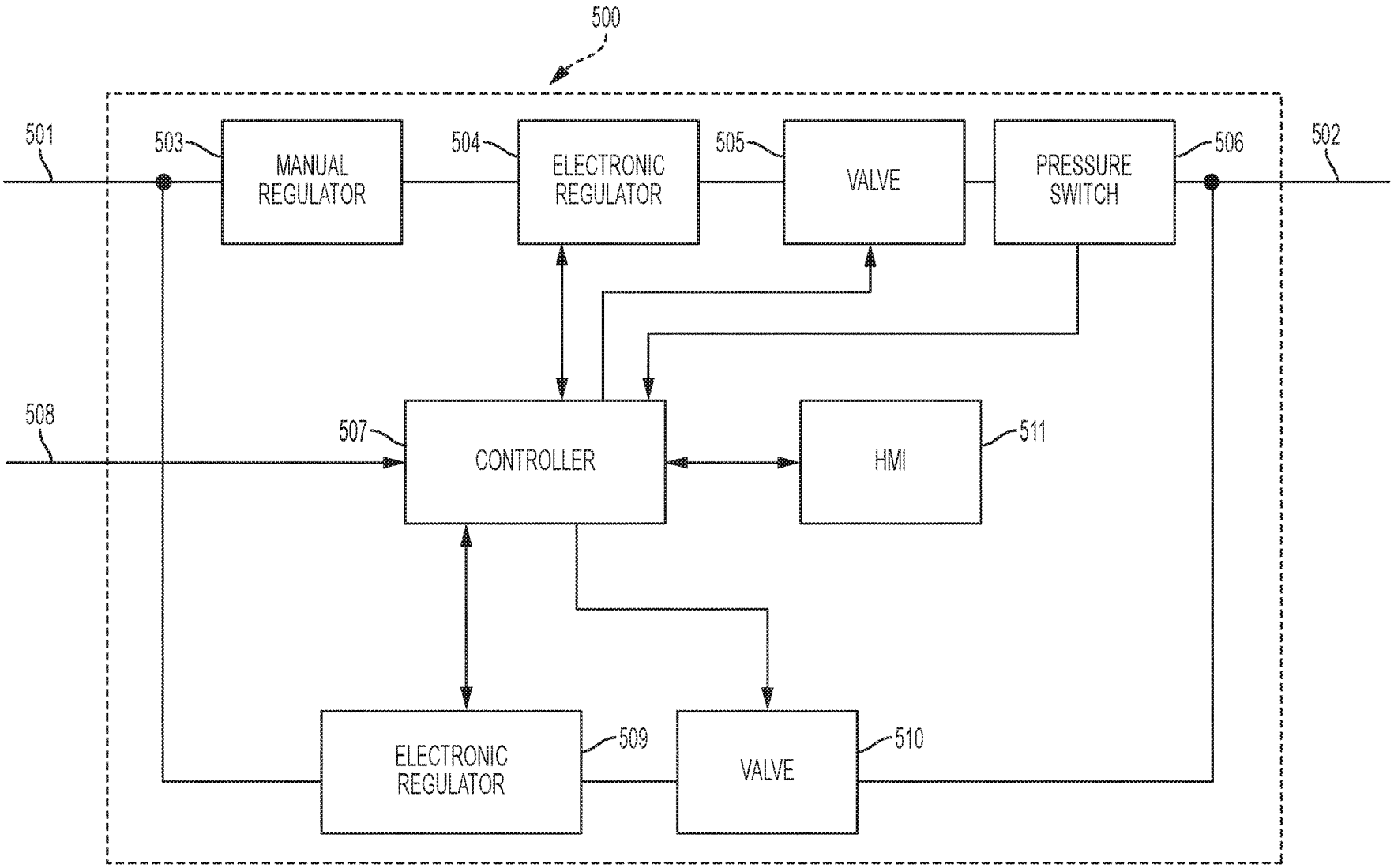
FIG. 5 is an exemplary diagram of a pressure control system in accordance with another embodiment.

FIG. 5 illustrates a pressure control system 500 according to another embodiment. The pressure control system 500 includes a primary control path and a secondary control path. The primary control path comprises a manual regulator 503, an electronic regulator 504, a valve 505, and a pressure switch 506. The primary control path controls the head pressure of a holding tank during operation.

The pressure control system 500 has a pressurized inlet 501 and a pressurized outlet 502. The pressurized inlet 501 is connected to the manual regulator 503 as a pressurized input. The pressurized outlet 502 may be connected to the inlet of a holding tank by a pressurized gas line. The pressurized outlet 502 of the pressure control system 500 may force pressurized air into a holding tank to control the head pressure of the holding tank.

The manual regulator 503 steps down the pressure from the pressurized inlet 501 to a lower pressure level. By decreasing the pressure from the pressurized inlet 501, the manual regulator limits the pressure at the input of the electronic regulator 504. The pressure set point of the manual regulator 503 may be set manually by a user. The pressure set point of the manual regulator 503 may be controlled by an adjustment screw, spring, or other mechanism.

The electronic regulator 504 is connected to the outlet of the manual regulator 503. The electronic regulator 504 includes a pressurized inlet, a pressurized outlet, and a pressure set point input. The manual regulator 503 feeds a regulated, pressurized gas to the input of the electronic regulator 504. The electronic regulator 504 regulates the pressure at its outlet based on the set point input. When the primary control path is enabled, the electronic regulator 504 sets the pressure of the pressurized outlet 502 of the pressure control system 500. The electronic regulator 504 may have greater accuracy and repeatability than the manual regulator 503. In some embodiments, the electronic regulator 504 may be a Proportion Air QPV-1 model.

In some embodiments, the pressure set point input of the electronic regulator 504 may be controlled by an electrical signal. For example, the pressure set point of the electronic regulator 504 may be controlled by an analog input, such as a 4-20 mA current loop. In other embodiment, the pressure set point of the electronic regulator 504 may be controlled by a serial digital communication protocol, such as RS-232 or DeviceNet.

The pressure set point input of the electronic regulator 504 is controlled by a controller 507. The controller receives as an input a signal 508 corresponding to the amount of product in a holding tank. The controller adjusts the pressure set point of the electronic regulator 504 based on the signal 508.

The electronic regulator 504 may have an integrated pressure transducer for measuring the input pressure and/or the output pressure of the electronic regulator 504. The electronic regulator 504 may send information to the controller 507 corresponding to the input pressure and/or the output pressure of the electronic regulator 504.

The controller 507 may be of various types. For example, the controller 507 may be a programmable logic controller, a microcontroller, or other device capable of controlling the pressure set point input of the electronic regulator 504. For example, the controller 507 may be an Allen-Bradley PLC.

The primary control path of the pressure control system 500 may be enabled or disabled by a valve 505. When the valve 505 is open, the primary control path is enabled and the pressurized outlet 502 of the pressure control system 500 is connected to the pressure output of the electronic regulator 504. When the valve 505 is closed, the primary control path is disabled.

The valve 505 may be controlled by the controller 507. In other embodiments, the valve 505 may be controlled manually by a user. The valve 505 may be of various types. For example, the valve 505 may be a solenoid valve, a pneumatic valve, a hydraulic valve, or a manual valve.

The pressure switch 506 protects the integrated pressure transducer of the electronic regulator 504 from overpressure. The pressure switch 506 may transmit a signal to the controller 507 indicating the presence or absence of an overpressure condition. In the event of an overpressure condition, the controller 507 may close the valve 505 and disable the primary control path.

The secondary control path of the pressure control system 500 includes an electronic regulator 509 and a valve 510. The secondary control path may be used to initially charge the pressure of a holding tank prior to filling. The secondary control path may be used as an alternative to the primary control path during filling if the user wishes to maintain a single head pressure set point throughout the batch cycle.

The electronic regulator 509 includes a pressurized inlet, a pressurized outlet, and a pressure set point input. When the secondary control path is enabled, the pressurized outlet 502 of the pressure control system 500 is connected to the outlet of the electronic regulator 509. The electronic regulator 509 may be used to set the initial pressure of the holding tank. The electronic regulator 509 may be used during operation as an alternative to electronic regulator 504 if the user wishes to maintain a single head pressure in the holding tank throughout the batch cycle.

The electronic regulator 509 may have a wider pressure range than electronic regulator 504 because the pressure input of electronic regulator 509 is not controlled by a manual regulator. The electronic regulator 509 may have less accuracy and/or repeatability than electronic regulator 504 because electronic regulator 509 does not adjust the head pressure of the holding tank during operation based on the amount of product in the holding tank. In some embodiments, the electronic regulator 509 may be a Proportion Air QB3 model.

The secondary control path of the pressure control system 500 may be enabled or disabled by a valve 510. When the valve 510 is open, the secondary control path is enabled and the pressurized outlet 502 of the pressure control system 500 is connected to the pressure output of the electronic regulator 509. When the valve 510 is closed, the secondary control path is disabled. The primary and secondary control paths may be disabled simultaneously to disable the pressure control system 207.

The valve 510 may be controlled by the controller 507. In other embodiments, the valve 510 may be controlled manually by a user. The valve 510 may be of various types. For example, the valve 510 may be a solenoid valve, a pneumatic valve, a hydraulic valve, or a manual valve.

The pressure control system of FIG. 5 may comprise a human machine interface (HMI) 511. The HMI 511 may permit a user to set a product pressure set point, a pressure tolerance, a filling amount set point, and/or a filling amount tolerance for the product filling system. The HMI 511 may permit a user to enable and/or disable the primary and secondary control paths of the pressure control system 500. The HMI 511 may permit a user to choose whether the pressure control system 500 adjusts the head pressure of a holding tank throughout a batch cycle to maintain a constant product pressure or whether the pressure control system maintains a single head pressure throughout the batch cycle.

The HMI 511 may display information about the filling system. The HMI 511 may display the pressure at the pressurized outlet 502 of the pressure control system 511. The HMI 511 may display the pressure set point of the pressure control system 500, the pressure set point of the electronic regulator 504, the pressure set point of the electronic regulator 509, whether valves 505 and 510 are open or closed, and/or whether the primary and secondary control paths are enabled or disabled. The HMI 511 may display the value of the signal 508 corresponding to the amount of product in the holding tank.

The systems and methods described above allow for product filling without the need to monitor and/or adjust the filling time and/or the filling amount by maintaining a constant product pressure throughout a batch-filling cycle. These systems and methods may overcome disadvantages associated with conventional product filling systems. For example, some conventional product filling systems use buffer tanks to control product pressure. A buffer tank, which is typically smaller than a holding tank, is placed between the holding tank and the container. During operation, product is transferred from a holding tank to a buffer tank at periodic intervals. Typically, the head pressure of a buffer tank is regulated to a set value. Because a buffer tank is smaller than a holding tank, the difference in output pressure between a full tank and an empty tank is smaller in a buffer tank relative to a holding tank when the head pressure is fixed. Therefore, the pressure at the output of a buffer tank fluctuates within a narrower range of values than that of a holding tank as a larger quantity of product is dispensed from the holding tank.

However, buffer tanks have a number of shortcomings. A buffer tank must be refilled periodically during a batch-filling cycle both because it is smaller than the holding tank and to maintain a product pressure inside the buffer tank within a desired tolerance. Refilling the buffer tank requires a time delay between container-filling cycles.

According to some embodiments, the systems and methods described herein do not require any time delay to maintain the product pressure throughout a batch-filling cycle because the pressure control system can continuously compensate for reduction in the product amount in the holding tank to maintain a constant product pressure. Therefore, the disclosed pressure control system may be added to an existing product filling system without the need to adjust the timing of the filling process.

In conventional filling systems utilizing buffer tanks, the pressure at the output of the holding tank must be higher than the desired product pressure in the buffer tank to transfer product from the holding tank to the buffer tank because the product pressure inside the buffer tank is kept within an acceptable container-filling pressure. Therefore, as the buffer tank is refilled, the pressure inside the buffer tank rises above the desired container-filling pressure. After refilling the buffer tank, pressure must be released from the buffer tank to reestablish the desired product pressure before filling resumes. Decreasing pressure inside a tank may result in additional time delay during filling.

According to some embodiments, pressure does not need to be decreased in any tank during a batch-filling cycle in the system described above. During operation, the product pressure at the output of the holding tank decreases as product is fed from the holding tank to the inlet of the BFS. Therefore, maintaining a constant product pressure at the output of the holding tank only requires increasing the head pressure of the holding tank throughout the batch-filling cycle.

Adding a buffer tank to existing filling systems can be expensive and require extensive modification to a filling system. According to some embodiments, the pressure control system described above can be added to existing filling systems with minimal modifications. A regulator that maintains a constant head pressure in a holding tank may be replaced with the pressure control system described above to adjust the head pressure throughout a batch-filling cycle without any further modifications to the filling system. Alternatively, a pressure control system as described above may be inserted into a pressurized gas line feeding the inlet of a holding tank to adjust the head pressure throughout a batch-filling cycle without any further modifications to the filling system.

Further, adding a buffer tank changes the product pathway of the filling product. Changes in the product pathway can require regulatory intervention in some industries, resulting in additional cost and time delay. For example, in the pharmaceutical industry, changes in the product pathway can require that the filling system be recertified with the relevant regulatory authorities before production may resume, causing substantial cost and/or production delay.

According to some embodiments, a pressure control system according to the systems and methods described above can be retrofitted to an existing product filling system without changing the product pathway. For example, according to some embodiments, a controller can be retrofitted to an existing regulator on an existing holding tank head pressurization system. The sensor for sensing the amount of material in the holding tank may be preexisting in the system and may be communicatively connected to the controller. In some embodiments, the sensor and regulator may be added to the existing system.

Figure 6:
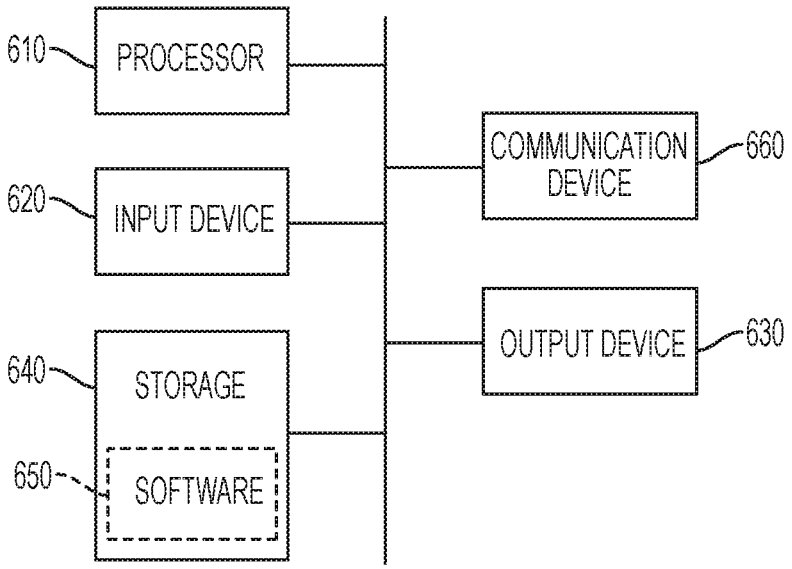
FIG. 6 illustrates an example of a computer in accordance with one embodiment.

FIG. 6 illustrates an example of a computer in accordance with one embodiment. Computer 600 can be a component of a container filling system, such as system 200 of FIG. 2, or can include the entire system itself. In some embodiments, computer 600 is a component of a control system for controlling the head pressure of a holding tank, such as control system 207 of FIG. 2 and/or controller 507 of FIG. 5.

Computer 600 can be a host computer connected to a network. Computer 600 can be a client computer or a server. As shown in FIG. 6, computer 600 can be any suitable type of microprocessor-based device, such as programmable logic controller, a microcontroller, a personal computer, workstation, server, or handheld computing device, such as a phone or tablet. The computer can include, for example, one or more of processor 610, input device 620, output device 630, storage 640, and communication device 660. Input device 620 and output device 630 can generally correspond to those described above and can either be connectable or integrated with the computer.

Input device 620 can be any suitable device that provides input, such as a touch screen or monitor, keyboard, keypad, mouse, or voice-recognition device. Output device 630 can be any suitable device that provides output, such as a touch screen, indicator light panel, monitor, printer, disk drive, or speaker.

Storage 640 can be any suitable device that provides storage, such as an electrical, magnetic, or optical memory, including a RAM, cache, hard drive, CD-ROM drive, tape drive, or removable storage disk. Communication device 660 can include any suitable device capable of transmitting and receiving signals over a network, such as a network interface chip or card. The components of the computer can be connected in any suitable manner, such as via a physical bus or wirelessly. Storage 640 can be a non-transitory computer readable storage medium comprising one or more programs, which, when executed by one or more processors, such as processor 610, cause the one or more processors to perform methods described herein or portions of method described herein, such as method 300 of FIG. 3.

Software 650, which can be stored in storage 640 and executed by processor 610, can include, for example, the programming that embodies the functionality of the present disclosure (e.g., as embodied in the systems, computers, servers, and/or devices as described above). In some embodiments, software 650 can include a combination of servers such as application servers and database servers.

Software 650 can also be stored and/or transported within any computer-readable storage medium for use by or in connection with an instruction execution system, apparatus, or device, such as those described above, that can fetch instructions associated with the software from the instruction execution system, apparatus, or device and execute the instructions. In the context of this disclosure, a computer-readable storage medium can be any medium, such as storage 640, that can contain or store programming for use by or in connection with an instruction execution system, apparatus, or device.

Software 650 can also be propagated within any transport medium for use by or in connection with an instruction execution system, apparatus, or device, such as those described above, that can fetch instructions associated with the software from the instruction execution system, apparatus, or device and execute the instructions. In the context of this disclosure, a transport medium can be any medium that can communicate, propagate, or transport programming for use by or in connection with an instruction execution system, apparatus, or device. The transport readable medium can include, but is not limited to, an electronic, magnetic, optical, electromagnetic, or infrared wired or wireless propagation medium.

Computer 600 may be connected to a network, which can be any suitable type of interconnected communication system. The network can implement any suitable communications protocol and can be secured by any suitable security protocol. The network can comprise network links of any suitable arrangement that can implement the transmission and reception of network signals, such as wireless network connections, T1 or T3 lines, cable networks, DSL, or telephone lines.

Computer 600 can implement any operating system suitable for operating on the network. Software 650 can be written in any suitable programming language, such as C, C++, Java, or Python. In various embodiments, application software embodying the functionality of the present disclosure can be deployed in different configurations, such as in a client/server arrangement or through a Web browser as a Web-based application or Web service, for example.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

The invention claimed is:

1. A method of filling containers with liquid product, comprising:

receiving, by a controller, a signal from at least one weight sensor corresponding to a weight of a holding tank holding the liquid product, the holding tank having an outlet for feeding the liquid product to a container filling apparatus;

transferring liquid product from the outlet of the holding tank to an inlet of the container filling apparatus; and filling at least one container with the liquid product through at least one nozzle of the container filling apparatus for a predetermined fill time, wherein an amount of the liquid product dispensed during the predetermined fill time is based on a pressure at the outlet of the holding tank;

determining, by the controller, a pressure corresponding to an amount of the liquid product in the holding tank based on the signal from the at least one weight sensor and at least one dimension of the holding tank;

comparing, by the controller, the determined pressure to a predetermined pressure setpoint; and increasing, by the controller, a head pressure in the holding tank based on the comparison between the determined pressure and the predetermined pressure setpoint to control the pressure at the outlet of the holding tank as the liquid product is fed from the holding tank.

2. The method of claim 1, wherein the controller comprises a pressure regulator for increasing the head pressure of the holding tank.

3. The method of claim 1, wherein the head pressure is increased based on a density of the liquid product.

4. The method of claim 1, wherein the amount of the liquid product dispensed during the predetermined fill time is a linear function of the pressure at the outlet of the holding tank.

5. The method of claim 1, wherein the container filling apparatus is a blow-fill-seal apparatus.

6. The method of claim 1, wherein the container filling apparatus is configured to mold the at least one container.

7. The method of claim 1, wherein the at least one weight sensor comprises a load cell.

8. The method of claim 1, wherein the pressure at the outlet of the container filling apparatus is maintained within 10% of a pressure set point.

9. The method of claim 1, wherein the holding tank is configured to continuously feed a batch of the liquid product to the container filling apparatus for at least 1 hour.

10. The method of claim 1, wherein the holding tank has a volume of at least 10 liters.

11. The method of claim 1, wherein the container filling apparatus is configured to fill a container with an amount of liquid product of less than 100 mL.

12. The method of claim 1, wherein the liquid product is a pharmaceutical product.

13. The method of claim 1, wherein the at least one container is sealed within the container filling apparatus after being filled.

14. A container filling system, comprising:

a holding tank configured to contain a liquid product;

a container filling apparatus comprising an inlet for receiving liquid product from the holding tank and at least one nozzle for filling containers, the container filling apparatus being configured to fill a container with liquid product for a predetermined fill time, wherein an amount of the liquid product filled during the predetermined fill time is based on a pressure at an outlet of the holding tank;

at least one weight sensor configured to generate a signal corresponding to a weight of the holding tank holding the liquid product; and a controller configured to receive the signal from the at least one weight sensor, determine a pressure corresponding to the amount of the liquid product in the holding tank based on the signal from the at least one weight sensor and at least one dimension of the holding tank, compare the determined pressure to a predetermined pressure setpoint, and increase a head pressure in the holding tank based the comparison between the determined pressure and the predetermined pressure setpoint to control the pressure at the outlet of the holding tank as the liquid product is fed from the holding tank to the container filling apparatus.

15. The system of claim 14, wherein the controller comprises a pressure regulator for increasing the head pressure of the holding tank.

16. The system of claim 14, wherein the container filling apparatus is a blow-fill-seal apparatus.

17. The system of claim 14, wherein the container filling apparatus is configured to mold the container.

18. The system of claim 14, wherein the at least one weight sensor comprises a load cell.

19. The system of claim 14, wherein the holding tank has a volume of at least 10 liters.

20. The system of claim 14, wherein the container filling apparatus is configured to fill the container with an amount of liquid product of less than 100 mL.

21. The system of claim 14, wherein the liquid product is a pharmaceutical product.

22. The system of claim 14, wherein the container filling apparatus is configured to seal the container after filling the container.

23. The method of claim 1, wherein the head pressure in the holding tank is increased only between container filling cycles.

* * * * *